US007475502B2

(12) United States Patent
Bösebeck et al.

(10) Patent No.: US 7,475,502 B2
(45) Date of Patent: Jan. 13, 2009

(54) HYDRAULIC CONTROL SYSTEM FOR CONSTRUCTION VEHICLE, PARTICULARLY EXCAVATORS

(75) Inventors: Volker Bösebeck, Kamen (DE); Erik Lautner, Potsdam (DE); Jürgen Weber, Dresden (DE)

(73) Assignee: CNH Baumaschinen GmbH, Berlin (DE)

( * ) Notice: Subject to any disclaimer, the term of this patent is extended or adjusted under 35 U.S.C. 154(b) by 19 days.

(21) Appl. No.: 10/567,805

(22) PCT Filed: Jul. 13, 2004

(86) PCT No.: PCT/DE2004/001513

§ 371 (c)(1),
(2), (4) Date: Sep. 8, 2006

(87) PCT Pub. No.: WO2005/015030

PCT Pub. Date: Feb. 17, 2005

(65) Prior Publication Data

US 2007/0056437 A1 Mar. 15, 2007

(30) Foreign Application Priority Data

Aug. 8, 2003 (DE) ..... 103 36 334

(51) Int. Cl.
*E01H 5/02* (2006.01)

(52) U.S. Cl. ..... 37/348; 37/414; 60/421

(58) Field of Classification Search ..... 37/382, 37/348, 902; 60/429, 421, 424; 137/884
See application file for complete search history.

(56) References Cited

U.S. PATENT DOCUMENTS

| | | | | | |
|---|---|---|---|---|---|
| 3,631,762 | A | * | 1/1972 | Fuzzell | 91/217 |
| 3,720,059 | A | | 3/1973 | Schurawski et al. | |
| 3,733,964 | A | * | 5/1973 | Schantz | 91/517 |
| 3,800,669 | A | | 4/1974 | Distler | |
| 3,922,855 | A | | 12/1975 | Bridwell et al. | |
| 3,945,138 | A | * | 3/1976 | Heusler et al. | 37/190 |
| 4,033,236 | A | * | 7/1977 | Johnson et al. | 91/463 |
| 4,129,258 | A | * | 12/1978 | Mott et al. | 239/650 |
| 4,693,272 | A | * | 9/1987 | Wilke | 137/596 |
| 4,782,859 | A | * | 11/1988 | Constantinian | 137/596.2 |
| 5,083,428 | A | * | 1/1992 | Kubomoto et al. | 60/421 |
| 5,529,088 | A | * | 6/1996 | Asou | 137/343 |
| 5,715,865 | A | * | 2/1998 | Wilke | 137/596 |
| 5,996,341 | A | * | 12/1999 | Tohji | 60/421 |
| 6,018,895 | A | * | 2/2000 | Duppong et al. | 37/348 |
| 7,021,332 | B2 | * | 4/2006 | Greenwood et al. | 137/596 |

FOREIGN PATENT DOCUMENTS

| | | |
|---|---|---|
| DE | 2364282 | 7/1975 |
| GB | 1057752 | 2/1967 |

* cited by examiner

*Primary Examiner*—Thomas A Beach
(74) *Attorney, Agent, or Firm*—Patrick M. Sheldrake; John William Stader; Michael G. Harms

(57) ABSTRACT

The invention relates to a hydraulic control system for building machinery, particularly for controlling hydraulic consumers of an excavator. According to the invention, pump channels which ensure that the hydraulic consumers are supplied in parallel by means of a spool valve of the main control unit of the piece of building machinery are provided in addition to previously existing pump channels that ensure said hydraulic consumers are serially supplied with hydraulic fluid. The additional pump channels are arranged parallel to the previously existing ones.

12 Claims, 7 Drawing Sheets

HYDRAULIC CONTROL SYSTEM FOR CONSTRUCTION VEHICLE, PARTICULARLY EXCAVATORS

FIELD OF THE INVENTION

The invention concerns a hydraulic control system for a construction vehicle, particularly for the control of the hydraulic loads of an excavator, in accordance with the preamble of patent claim 1.

BACKGROUND OF THE INVENTION

A load sensing system (LUDV) with proportional flow rate reduction for all hydraulic loads, if the volumetric current of hydraulic fluid provided by the pump is insufficient for supplying all the hydraulic loads, is known from the state of the art. This regulation strategy is implemented by pressure compensators, located downstream of the spool valve. The pressure compensators maintain a constant difference in pressure, and thus one independent of the load across the A-B control edge on the load side.

Negative flow control (NFC) is also a very common hydraulic control system, in which spool valve deflection entails a reduction in the volumetric current in the open center duct and thus a reduction in the volumetric control current used at the negative flow control valve. In the negative flow control valve, the change in the volumetric control flow is converted into a difference in pressure, which is used as a signal for controlling pumps. Unlike load sensing systems, no load compensation is carried out by the pressure compensators.

Moreover, the load sensing system (PMSIII) is known in the state of the art from patent specification DE 23 64 282 C3. It is characteristic of this control system that the pumps are set to a greater volumetric displacement as control pressure increases, on the "positive control principle". The cross-section of control edges C1 and C2 then decreases on the pump side, with the volumetric current of fluid accumulating in front of said control edges C1 and C2. Simultaneously, the control edges A and B on the load side start to open, causing both the pressure of the loads and the system pressure accumulated by control edges C1 and C2 to act upon the load holding valves until the system pressure opens them so that the volumetric current of fluid can flow through the increasing cross sections of the control edges A and B on the load side.

Following the comparison of the control systems for construction vehicles most commonly used in practice, it will be clear that, in accordance with the load-sensing system (PMSIII) mentioned, a load without additional components can be supplied with a volumetric current of fluid by means of the 8/3 way spool valve and the corresponding block structure, produced by the combination of two pumps in the block. By using two pumps, by which hydraulic fluid can be applied in series to the spool valves, the block structure permits two or, in conjunction with the stewing radius, even three system pressures to be used for operation. A further advantage, which may not be underestimated, is that various system matches can be achieved by parallel actuation of the two pumps and spool valve, producing different machine responses, depending upon use of the construction vehicle or the wishes of the customer. The operator retains sensitivity to the digging process because the individual hydraulic functions are not actuated with load pressure compensation.

Hydraulic decoupling of the individual functions is also accomplished simply, by the C control edges of the spool valves, which close the pump ducts as a function of the stroke when actuating or deflecting the spool valve. Neither are any valve-type pressure compensators required, which is firstly energetically efficient and secondly produces a hydraulic control system with a simple structure.

Despite this mature control system in accordance with patent DE 23 64 282 C3, some disadvantages arise from the type of main control block architecture. For example, the series arrangement of spool valves in conjunction with the C edges has the disadvantage that loads may be under-supplied. In particular, there is a danger of restriction of the intended function of loads under-supplied with hydraulic fluid by spool valves located in the middle of the main control block. Such partially restricted supply of loads is further aggravated by the restricted ability to control options or additional functions, particularly if a specific volumetric current is required. In the past, a specific volumetric current had to be set when an additional function, e.g. a cutter or magnetic system, was used, by means of setting one of the two main pumps to a specific volumetric displacement. This greatly restricted the extent of the function of the remaining hydraulic system, as one of the two main pumps was only available exclusively for this additional function.

It is not technically possible to extend the existing main control block to accommodate special functions at the end by means of so-called sandwich elements. Special functions therefore have to be integrated by means of additional valves and hoses, entailing not inconsiderable technical outlay and the associated costs.

SUMMARY OF THE INVENTION

The purpose of the invention is to develop a hydraulic control system by means of which the disadvantages of series supply are overcome and which facilitates a load-sensitive supply of hydraulic fluid to the loads while simultaneously retaining the advantages of simple internal combination of pump volumetric currents and the possibility of operating at different system pressures. An additional purpose of the invention is to be able to extend the existing main control block optionally, in order to integrate additional hydraulic loads into the hydraulic control system without considerable structural outlay.

This problem is solved inventively by the characteristics of claim 1. The sub-claims show further advantageous embodiments of the invention.

Surprisingly, this complex problem, the manifold aspects of which are apparently incompatible, can be solved by providing pump ducts P1 and P2, not extending through the spool valves, in addition to the existing pump ducts P01 and P02, which ensure a series supply of hydraulic fluid to the loads, in order to ensure a parallel supply to the hydraulic loads by means of the spool valves of the main control block of the construction vehicle which ensure the supply of a hydraulic fluid to the hydraulic loads, in parallel to pump ducts P01 and P02. In addition to a first bypass duct, a second bypass duct is inventively provided in each section of the main control block, forming a ring bypass with the first bypass duct. An additional volumetric current can be apportioned to the ring bypass from the parallel pump ducts P1 and P2. Apportionment may be achieved flexibly by different valve functions, such as chokes, one-way restrictors, pressure compensators, etc.

This allows the existing hydraulic control system to be flexibly expanded so that each load is supplied with the desired volumetric current load-sensitively by the spool valve allocated to it, insofar as the maximum installed volumetric current of the machine permits. All the loads can be operated simultaneously, and with load-pressure compensation and independently of each other, if pressure compensators are used. This produces greater convenience and more reliable operational control. Operational control means all the processes which the operator of the construction vehicle carries out using the hydraulic loads, e.g. the backhoe, boom or travel.

Preferably the additional pump ducts P1 and P2 extend in the direction of the longitudinal axis of the main control block in parallel to the existing pump ducts P01 and P02, pump ducts P1 and P01 being supplied by the first pump and pump ducts P2 and P02 by the second pump. Pump ducts P01 and P02 thus supply the hydraulic loads in series in the usual way and pump ducts P1 and P2 also supply the hydraulic loads in parallel, through the appropriate spool valves. The first pump and the second pump thus each feed a series duct and a parallel duct, namely pump ducts P01 and P1 and pump ducts P02 and P2.

A requirement for the further embodiment is that the main control block may consist of a one-piece casting or of several cast components of the same type, joined together. Independently of the manufacture of the main control block, it is subdivided into several sections, in each of which one spool valve is located for one load.

Immediately after the point of entry of pump pipes PL1 and PL2 into the main control block, they divide into pump ducts P01 and P1 and P02 and P2. All the pump ducts preferably extend in the direction of the longitudinal axis of the main control block, from their entry into the main control block to a terminating element.

The individual series of hydraulically-linked sections with 8/3-way spool valves for a control block have, as disclosed in patent specification DE 23 64 282 C3, one initial bypass duct each, which connects the pump ducts P01 and P02 with the control edges A and B on the load side. In addition, the sections of the spool valve have an inventive second bypass duct, through which the 8/3-way spool valves and thus the control edges A and B on the load side may be supplied with hydraulic fluid by means of the additional pump ducts P1 and P2.

Both these bypass ducts form a ring and are hydraulically linked, so that they form a common ring bypass, from which the volumetric current for the control edges A and B on the load side may be taken.

The connection between pump ducts P1 and P2 and the ring bypass may optionally be formed by check valves and/or one-way chokes and/or pressure compensators and/or blind plugs, depending on whether a spool valve is used.

In accordance with the inventive concept, the main control block may be extended by optional flange-mounting blocks, so that additional hydraulic loads or accessories can be integrated into the hydraulic system without having to engage in the cost-intensive and disadvantageous fitting of additional hoses. The options blocks have the same duct structure as the main control block. The options blocks are located between the terminating plate and the main control block, which preferably includes the basic functions of the construction vehicle. The restriction of the volumetric current of a hydraulic load supplied by an options block may be achieved in a particularly advantageous way by restricting the stroke of the control rod. Direct influence is exercised upon the effect of the additional pump ducts on the hydraulic control system by a practical design of the cross-section of the C control edges of the spool valves.

In a preferred embodiment of the invention, the options block has a standard pressure compensator. A desired volumetric current for the additional loads connected to this spool valve may be provided independently of the load pressure by means of this pressure compensator. The other hydraulic loads supplied by the main control block thus have no influence on the load supplied by the options block. The pressure compensator may be located alternatively between pump ducts P1 and/or P2 and the bypass ring duct.

Specific accessories, e.g. hydraulic hammers, require an almost unpressurized return pipe to the tank in order to function properly. This requirement is fulfilled by inventively locating a controllable hammer valve in the main control block. In this preferred embodiment of the invention, traditional, externally-located additional valves and their hose connections to the hammer control unit can largely be waived. The hammer valve has a main stage and a pilot stage to actuate it, the valve cores used in the main stage being identical to those of the check valves described later, for reasons of cost and standardization.

Depending upon the configuration of the construction vehicle, this hammer valve may be functionally allocated to either the spool valve in section 6 or the spool valve of an options block.

A summing valve, located in a terminating element of the main control block, is also provided to solve the problem. If necessary, this summing valve can be used to combine the volumetric currents of the hydraulic fluid flowing through pump ducts P1 and P2, with the objective of feeding this combined hydraulic current to a single hydraulic load. Particularly accessories which require a greater volumetric current to fulfill their purpose than can be provided by a single hydraulic pump can thus be supplied inventively.

The volumetric current of hydraulic fluid provided by the second pump through pump duct P2 which is not required by an optional load can be made available to pump duct P02 in a further alternative advantageous embodiment of the solution, namely by using an overflow valve. The preset pressure valve used at a specific threshold pressure provides the necessary pressure level in parallel duct P2 as a pilot stage, so that the additional functions in the options blocks are supplied at a higher priority, before the residual volumetric current is made available to the entire hydraulic system in pump duct P02.

The inventive hydraulic control system is fundamentally designed as a dual-pressure system, whereby, if necessary, both the pumps arranged in parallel can operate together hydraulically in such a way that the hydraulic control system may be operated as a single-pressure system by adding the volumetric currents from the first and second pump together.

A person skilled in the art will be able to verify that the inventive hydraulic system is characterized by a combination of characteristics of a demand control system and a load sensing system known from prior art. As each pump supplies an existing pump duct and an inventive additional pump duct with hydraulic fluid, hydraulic fluid can consequently be doubly admitted to each spool valve, entailing desired redundancy in terms of the hydraulic supply.

The principal significant advantages and characteristics of the invention over the state of the art are:

- Parallel supply of the hydraulic loads with hydraulic fluid by means of two additional pump ducts P1 and P2;
- Location of an additional second bypass duct, which forms a ring bypass with the first bypass duct and thus ensures a redundant supply of hydraulic fluid to the hydraulic loads from pump ducts P01, P02, P1 and P2;
- Combination of characteristics of the demand control system and of the load sensing system, thus enhancing the flexibility of the hydraulic system by the use of load holding valves, differential pressure valves, pressure relief valves and pressure compensators;

Upgradeability of the main control block by options blocks, whereby the volumetric current for the load supplied by this options block can be restricted by restricting the stroke of the control rod;

Use of an overflow valve, in order to make the proportion of the volumetric current of the hydraulic fluid supplied by means of the second pump through pump duct P2 and not required by an optional load available to the entire system through pump duct P02 if necessary;

Use of a summing valve to ensure the combination of volumetric currents of the hydraulic fluid flowing through pump ducts P1 and P2 if required, and;

Use of a controllable hammer valve for the unpressurized return of the hydraulic fluid, the hammer valve being located inside the main control block, to save on additional valves or hoses.

Different solutions and advantages of the invention will also become apparent to a person skilled in the art from the following detailed description of a preferred embodiment with reference to the appended drawings.

DETAILED DESCRIPTION OF THE PREFERRED EMBODIMENTS

Figure 1:
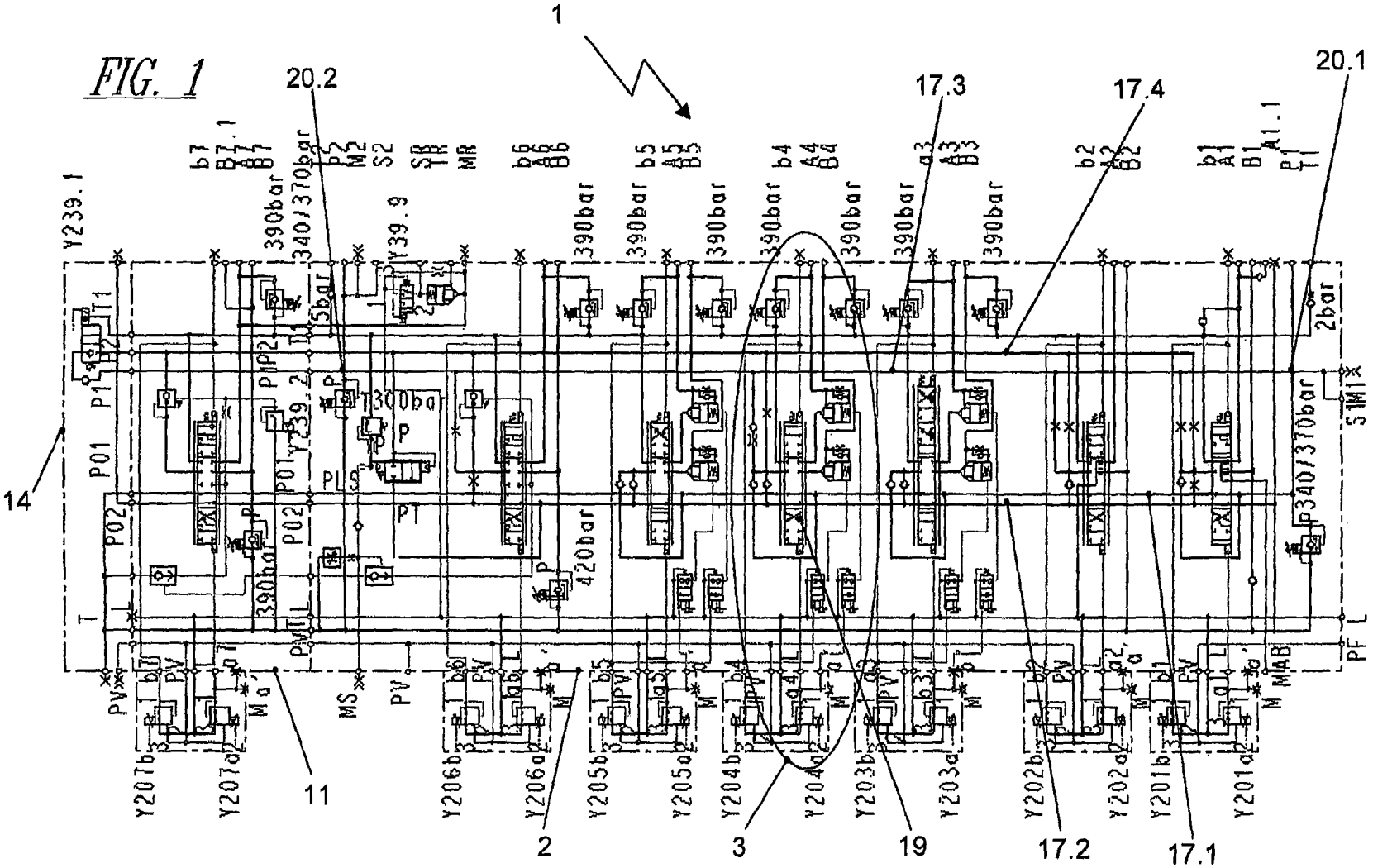
FIG. 1 is a basic hydraulic structure of the main control block.

FIG. 1 illustrates the basic hydraulic structure of the inventive hydraulic control system 1. The main control block generally designated 2 includes, as shown as an example, six sections 3, an options block 11, and a terminating element 14, which are connected with each other hydraulically and mechanically to form a solid block. Movable spool valves 19, by which the individual hydraulic loads are supplied with hydraulic fluid, are located inside the sections 3 and the options block 11. The existing pump ducts P01 17.1 and P02 17.2, which extend in the direction of the longitudinal axis of the main control block 2, are perpendicular to the spool valves 19. The hydraulic fluid, under pressure from the pumps 5 not shown, flows through the pump ducts 17.1 and 17.2 to the spool valves 19. The additional pump ducts P1 17.3 and P2 17.4 extend inventively in the direction of the longitudinal axis of the main control block 2 in parallel to the existing pump ducts P01 17.1 and P02 17.2, pump ducts P1 17.3 and P01 17.1 being supplied by a first pump 5.1 and pump ducts P2 17.4 and P02 17.2 by a second pump 5.2. Pump ducts P01 17.1 and P02 17.2 thus supply the hydraulic loads 18 not shown in the usual way in series and pump ducts P1 17.3 and P2 17.4 also supply the hydraulic loads 18 in parallel through the appropriate spool valves 19. The first pump 5.1 and the second pump 5.2 thus feed one series duct and one parallel duct each, namely pump ducts P01 17.1 and P1 17.3 and pump ducts P02 17.2 and P2 17.4. Pressurized pump pipes PL1 20.1 and PL2 20.2 divide into pump ducts P01 17.1 and P1 17.3 and P02 17.2 and P2 17.4 downstream of their inlet into the main control block 2. All the pump ducts 17 extend in the direction of the longitudinal axis of the main control block 2 through the options block 11 to a terminating element 14. The duct structure in each section 3 is almost identical, i.e. all sections 3 have similar apertures to form the pump ducts 17. As illustrated in more detail in FIG. 2, each spool valve 19 is supplied with hydraulic fluid through a first bypass duct 6.1 which has two load holding valves 24. As any person skilled in the art may verify, a desired position of the opening paths of the 8/3-way valve is achieved by means of the spool valve 19. Should demand increase, delivery of hydraulic fluid for the two outer spool valves 19 of the inner sections 3 may no longer be sufficient. Two additional pump ducts P1 17.3 and P2 17.4 have therefore been inventively provided. They extend along the longitudinal axis of main control block 2, in parallel to the existing pump ducts P01 17.1 and P02 17.2. In addition to the formation of these pump ducts P1 17.3 and P2 17.4, each individual section 3 has an aperture for each duct 17.3, 17.4, thus providing a connection with bypass duct 6.2.

Figure 2:
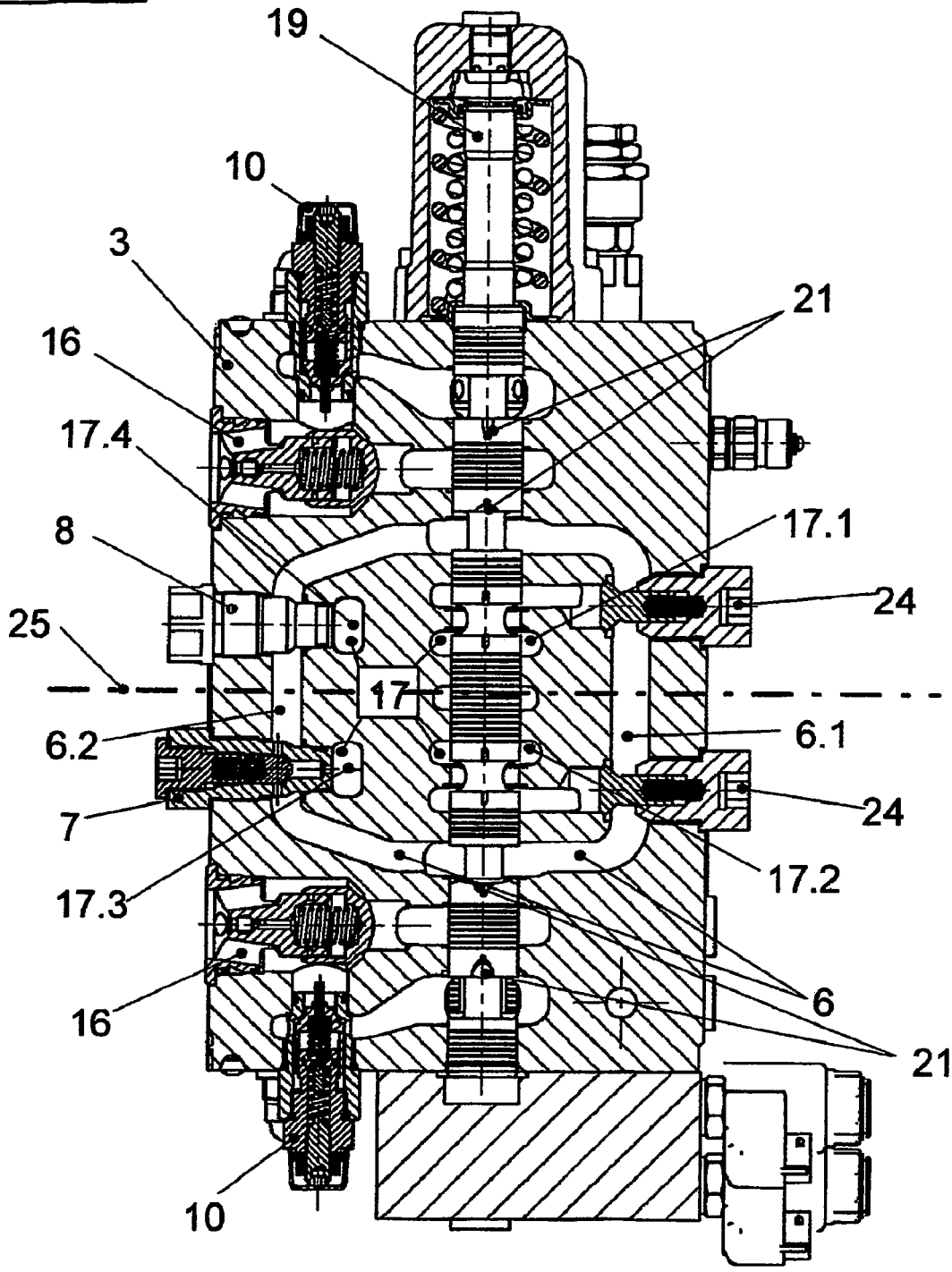
FIG. 2 is a detailed cross-section of the backhoe spool valve.

FIG. 2 shows a detail of a section 3 of the main control block 2, for example for the spool valve 19 of the hydraulic load 18 of the backhoe, not shown. Section 3 includes at least one spool valve 19 with its load-side control edges A and B 21, two bypass ducts 6.1, 6.2, two load-holding valves 24, one one-way restrictor 7, one blind plug 8 and two secondary pressure relief valves 10.

According to this illustration, the existing first bypass duct 6.1 is located to the right of spool valve 19 and the inventive second bypass duct 6.2 to the left of spool valve 19. Both bypass ducts 6.1, 6.2 are arranged in relation to each other so that they jointly form a ring bypass 6. The existing pump ducts P01 17.1 and P02 17.2 and the spool valve 19 with its load-side control edges A and B 21 are located in a theoretical first plane, which is oriented vertically in the figure shown. The two additional pump ducts P1 17.3 and P2 17.4 are located in a second theoretical plane, aligned in parallel with the first plane. Pump ducts P1 17.3 and P01 17.1 are arranged as a mirror image of pump ducts P2 17.4 and P02 17.2, around an axis of reflection, oriented perpendicularly to the first and second planes.

For the purposes of generic fulfillment of function, the first bypass duct 6.1 is hydraulically linked to pump ducts P01 17.1 and P02 17.2 and to the load-side control edges A and B 21 of the spool valve 19 of section 3; and the inventive second by-pass duct 6.2 is hydraulically linked to pump ducts P1 17.3 and P2 17.4 and to the load-side control edges A and B 21 of the spool valve 19 of section 3. Consequently, hydraulic fluid may be applied to spool valve 19, e.g. to supply the backhoe cylinder through pump ducts P01 17.1, P02 17.2 and P1 17.3. In the figure shown, blind plug 8 seals pump duct P2 17.4.

The first bypass duct 6.1 has two load-holding valves 24, while one one-way restrictor 7 and one blind plug 8 are located in the second bypass duct 6.2. A person skilled in the art will notice that the secondary pressure relief valves 10 are located on the load side of the spool valve 19. In this arrangement, the check valves 16 seal the load ducts A and B not shown in more detail so that no further external check valve manifolds are required to fulfill the function.

A pressure compensator 9 may also be used instead of the blind plug 8 or the one-way restrictor 7, rendering the spool valve 19 of section 3 and thus the entire hydraulic control system 1 highly versatile for the user's requirements.

In a further embodiment of the invention, the section 3 belonging to the hydraulic load 18/boom not shown has no second bypass 6.2. As the hydraulic supply to the boom cylinder has a sufficiently high priority in terms of lack of supply, this section 3 can also be embodied without the inventive second bypass 6.2. The supply to the cylinder for raising the boom is predominantly from the existing pump ducts P01 17.1 and P02 17.2. The boom is lowered by using its intrinsic weight and a specially-designed hollow spool valve, a partial volumetric current through the spool valve 19 from the piston chamber being used to fill the annulus of the cylinder. Because of this regenerative function no pump 5 is required for the lowering process.

A similarly-conceived regenerative function can also be used to control the stick cylinder. The use of check valves 16 is possible as an option, if, for example, undesired lowering of the jib due to leaks from the hydraulic circuit are to be avoided during longer periods of idleness. Alternatively, burst pipe protection systems may be used instead of check valves 16 to comply with the applicable safety requirements in relation to the use of the construction vehicle as lifting gear.

In a preferred embodiment of section 6 for the hydraulic load 18/neck cylinder not shown of the construction vehicle, the second bypass 6.2 has an additional blind plug 8 as well as a pressure compensator 9.

Figure 3:
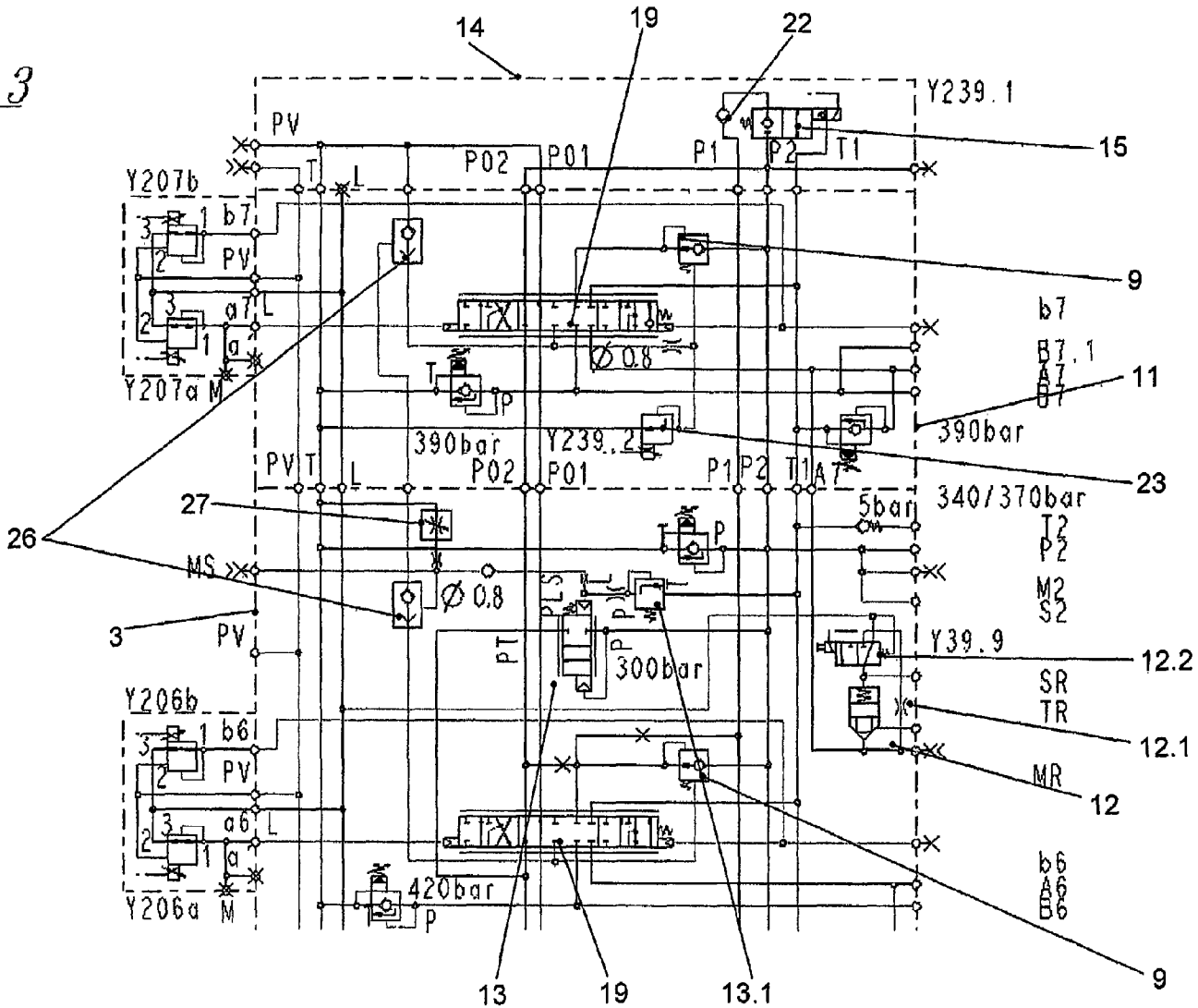
FIG. 3 is a detailed view of the basic hydraulic structure of the main control block with section 6 and pressure compensator, with overflow valve, with integral hammer valve, detailed view of an options block with a pressure compensator and load limiter and a detailed view of the terminating plate with a summing valve.

FIG. 3 shows a detail of section 6 of the main control block 2 in conjunction with an options block 11 and a terminating element 14.

An overflow valve 13, a hammer valve 12, a pressure compensator 9, a volumetric current regulator 27 to relieve load pressure, a first section of the shuttle valve chain 26 and a spool valve 19 form the significant characteristics of section 6 of the main control block 2.

The end of options block 11 is connected to the main control block 2 and includes a further spool valve 19, a pressure compensator 9, the load limiter 23 and a second part of the shuttle valve chain 26. The inventive summing valve 15 is located inside the terminating element 14, the end of which is connected to the options block 11.

The respective connection between the main control block 2, the options block 11 and terminating element 14 is made by a flanged connection, additionally secured by pressure-tight and temperature-resistant gaskets.

If several pressure compensators 9 are used simultaneously, e.g. to control a load through an options block 11 and a load through section 6 of main control block 2, load pressure comparison takes place by means of a shuttle valve chain 26.

Figure 4:
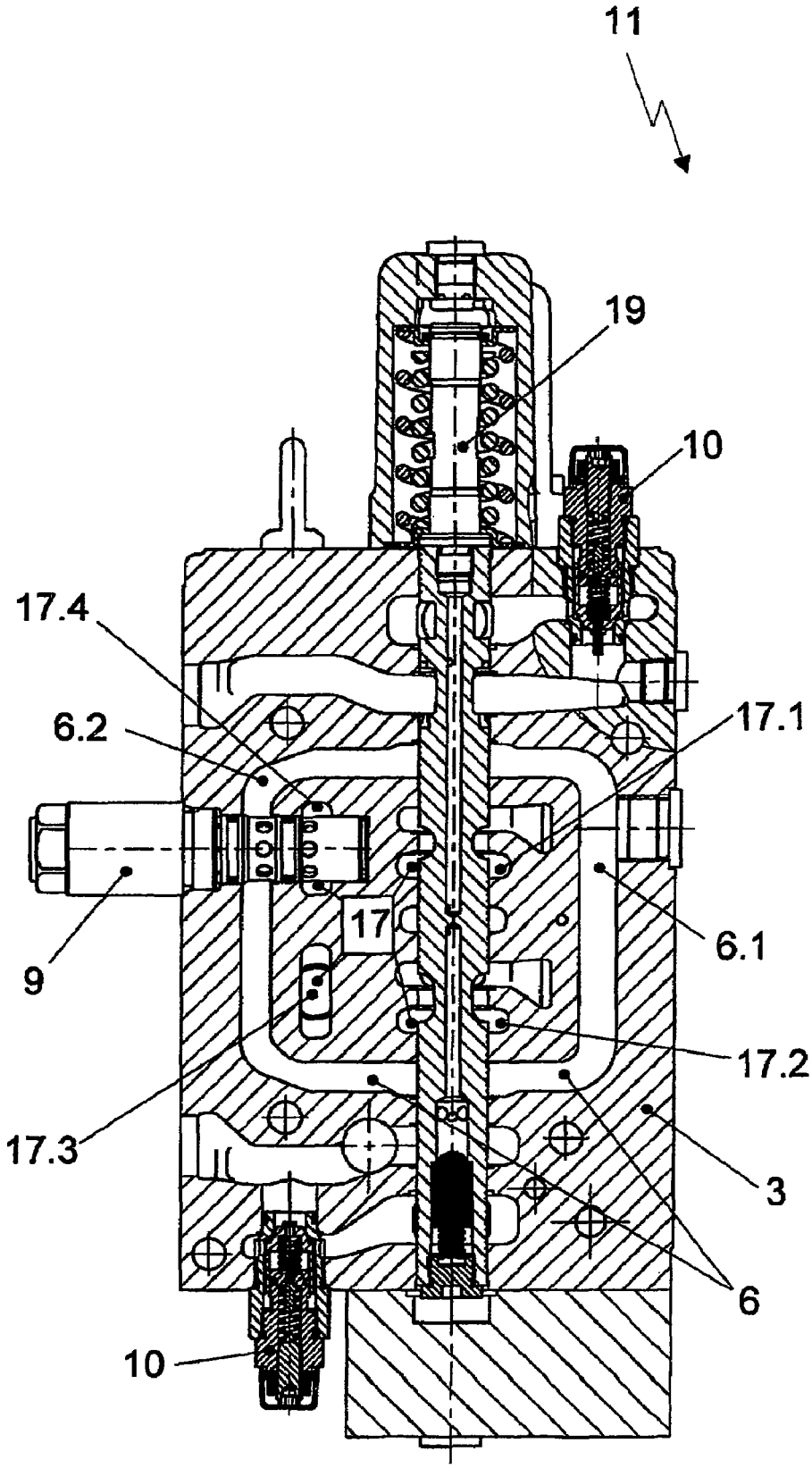
FIG. 4 is a detailed view of an options block using a pressure compensator.

As already demonstrated, flange-mountable options blocks 11 can be located on one end of the main control block 2, in order to integrate additional hydraulic loads 18 not shown in the hydraulic control system 1 without additional outlay for hoses. As illustrated by FIG. 4, the options block 11 has a second bypass duct 6.2, forming a ring bypass 6 in conjunction with the first bypass duct 6.1. The options blocks 11 thus have an identical duct structure 17 to the main control block 2. A pressure compensator 9 is located in the flow path of the second bypass duct 6.2, forming the connection between P2 17.4 and the second bypass duct 6.2, to ensure the desired independence of the hydraulic load 18 from the load. Two secondary pressure relief valves 10 are located on the respective load sides of the spool valve 19, protecting the hydraulic control system 1 from inadmissible external load pressures.

Figure 5:
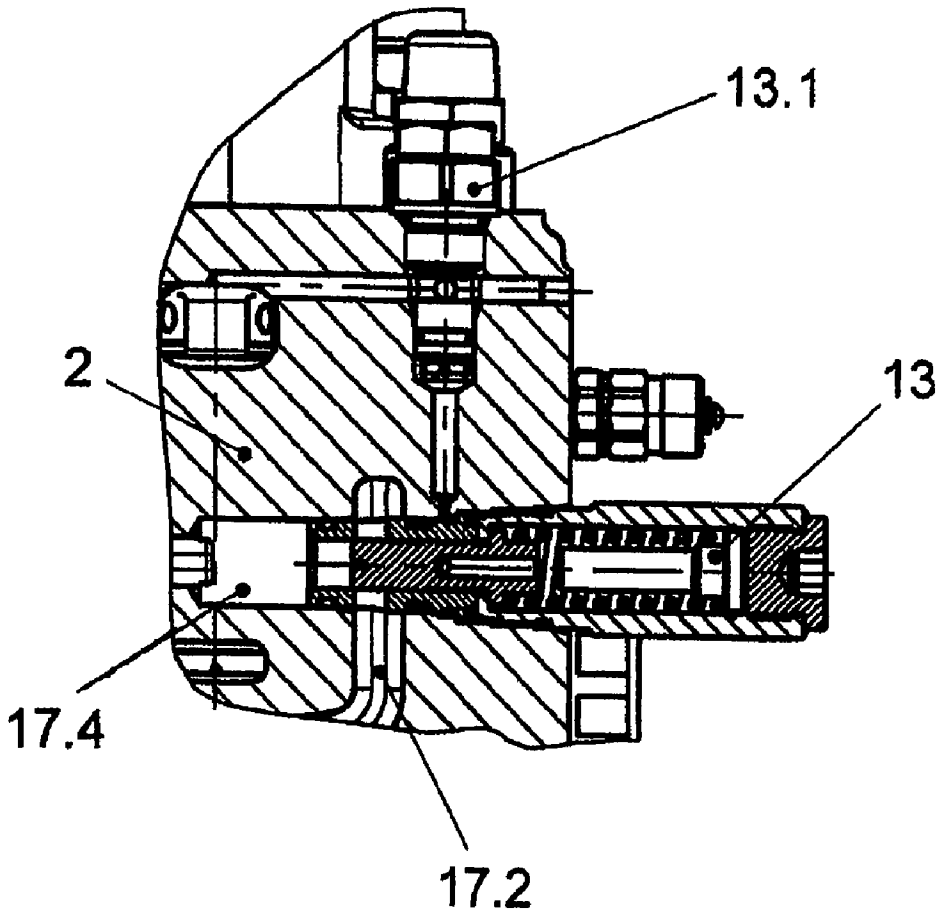
FIG. 5 is a detailed view of the main control block using an overflow valve.

FIG. 5 shows a detail of an overflow valve 13 which is located in the main control block 2. The overflow valve 13 connects pump duct P2 17.4 and pump duct P02 17.2 so that the volumetric current, which is provided by a pump 5.2 and is not required by the hydraulic loads 18 not shown in the options blocks 11 or by the hydraulic load of section 6, can flow from pump duct P2 17.4 to pump duct P02 17.2 when a certain pressure is reached. The permanently-set pressure relief valve 13.1 as the pilot stage of the overflow valve 13 provides the necessary pressure level in pump duct P2 17.4, guaranteeing the priority supply of hydraulic fluid to the accessories. Pilot valve 13.1 advantageously acts upon the internal pilot control pressure of overflow valve 13 to do so. Moreover, a flow controller 27 fitted with an additional nozzle is provided, which contributes to relieving the hydraulic indicator duct so that no unwanted hydraulic stresses occur.

Pump duct P2 17.4 supplies the hydraulic loads 18 of options block 11 or the load in section 6 of the main control block 2, while the hydraulic volumetric current through pump duct P02 17.2 not required by these loads is transferred to the entire system.

The energy from the residual volumetric current from pump 5.2 which is not used by the optional loads either is thus available to the entire system.

Figure 6:
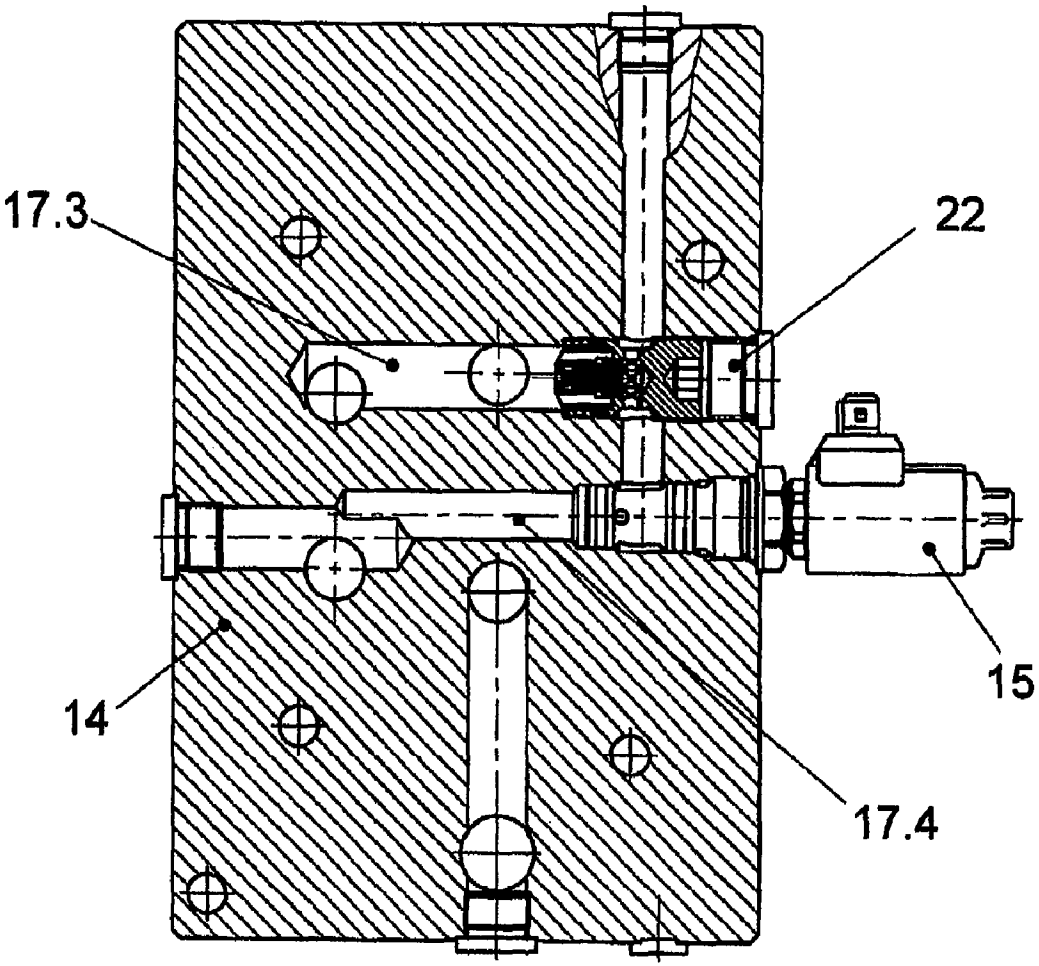
FIG. 6 is a detailed view of the terminating plate using a summing valve.

In contrast, a controllable inventive summing valve 15 may be provided, if a hydraulic load 18 requires a greater volumetric current than can be provided by the pump 5.2. This usually involves accessories which are supplied with hydraulic fluid by means of the spool valve 19 predominantly in the options blocks 11 by pump 5.2 through pump duct P2 17.4. Said summing valve 15 is located in terminating element 14 of main control block 2, as may be seen from FIG. 6. If need be, the volumetric currents from pump ducts P1 17.3 and P2 17.4 are combined and fed to a hydraulic load 18. Structurally, summing valve 15 is designed so that the volumetric current of hydraulic fluid from pump duct P1 17.3 flows into pump duct P2 17.4. Pump duct P1 17.3 has a non-return valve 22 in the vicinity of terminating element 14 for this purpose, to prevent the hydraulic fluid from flowing back.

Figure 7:
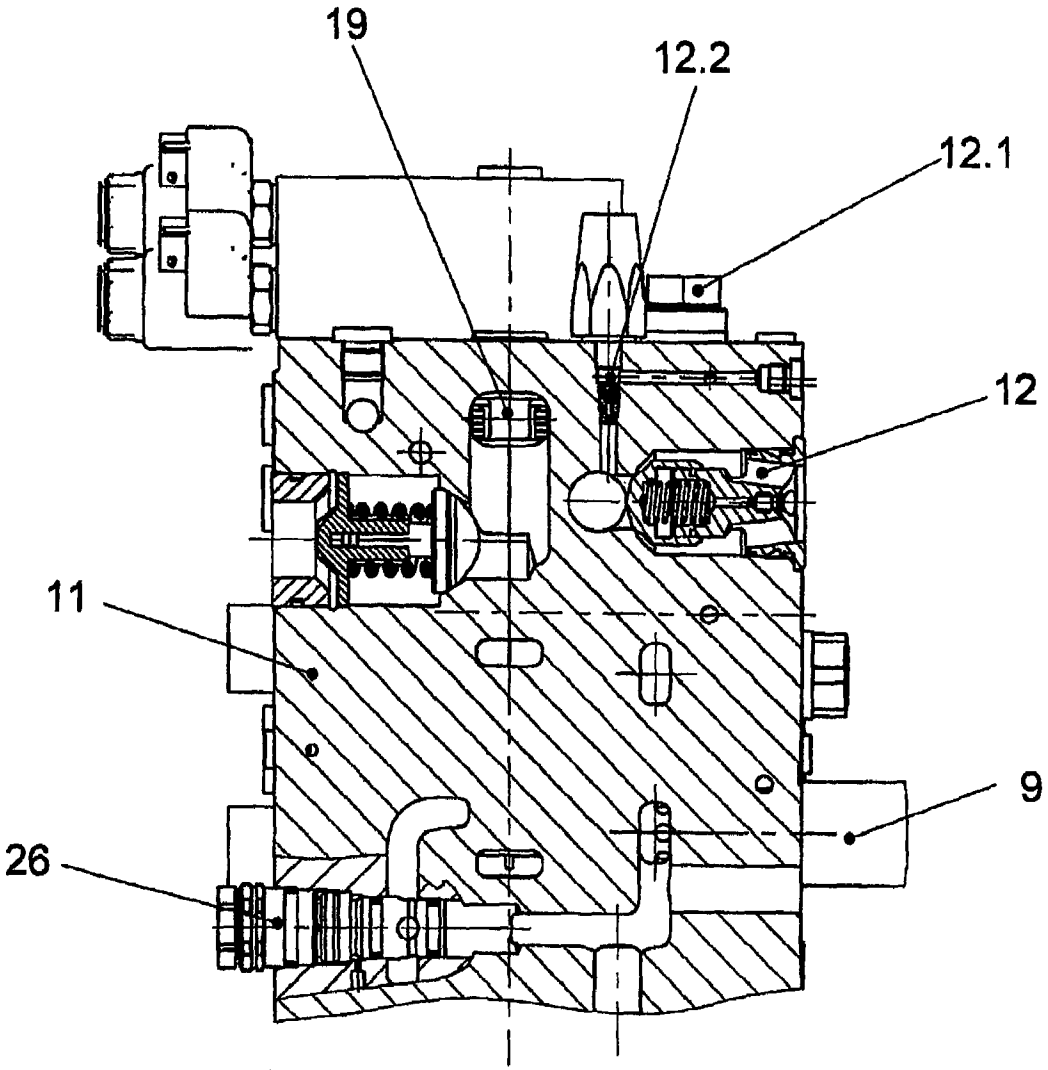
FIG. 7 is a detailed view of the main control block using an integral hammer valve.

Locating a controllable hammer valve 12 in the main control block 2 in accordance with FIG. 7 renders additional external valves superfluous, as the hydraulic fluid flowing into the hammer return is fed directly to the tank and not indirectly through the common return pipe of the main control block 2 downstream of the spool valves 19. The hammer valve 12 has a main stage and a pilot stage 12.1, the valve core of said main stage being identical to the valve core of the check valves 16, for reasons of cost and standardization. The pressure tapping aperture 12.2 provides an internal system pressure tap for pilot stage 12.1, which is used to relieve or apply pressure to open or close the main stage.

The inventive concept is still followed if valve cores other than those used in the check valves 16 are used.

Operation of the spool valves 19 of all sections 3 and of the spool valves 19 of options blocks 11 preferably takes place by electro-hydraulic pilot control, although standard hydraulic pilot control is also possible.

The inventive hydraulic control system 1 can now be used to produce a load-sensitive and flexible supply of hydraulic fluid to all hydraulic loads, energetically advantageous operation also being facilitated by the location of pump ducts P1 17.3 and P2 17.4 and the second bypass duct 6.2 connected to them, by using a summing valve 15, an overflow valve 13 and a controllable hammer valve 12.

We claim:

1. A hydraulic control system for a construction vehicle, particularly for the control of hydraulic loads of an excavator, having at least one main control block forming several sections with spool valves located therein, a hydraulic fluid tank and a first pair of pump ducts to which pressure may be applied by means of a first pump and a second pump for the supply of hydraulic fluid to the hydraulic loads in series through the spool valves, wherein a second pair of additional pump ducts are provided, which do not pass through the spool valves, parallel to the first pair of pump ducts, and which are designed to ensure an additional parallel supply to the hydraulic loads by means of the spool valves such that the first pump can feed one of the first pair of ducts in series and ones of the additional pairs of ducts in parallel and the second pump can feed the other one of the first pair of ducts in series and other one of the additional pairs of ducts in parallel.

2. A hydraulic control system for a construction vehicle in accordance with claim 1, wherein each section has a first bypass duct and a second bypass duct, the first bypass duct connecting the pump ducts with the respective spool valve and the second bypass duct connecting the additional pump ducts with the respective spool valve.

3. A hydraulic control system for a construction vehicle in accordance with claim 2, wherein the first bypass duct and the second bypass duct are linked together hydraulically and form a ring bypass.

4. A hydraulic control system for a construction vehicle in accordance with claim 1, wherein the main control block is designed to be extendable in the direction of its longitudinal extension by means of options blocks to expand the function of the hydraulic control system, whereby said options blocks are designed so that they are hydraulically linked to the pump ducts and to the additional pump ducts, and so that the options blocks have the same duct structure as the main control block.

5. A hydraulic control system for a construction vehicle in accordance with claim 1, wherein the main control block has a terminating element at at least one end, in which one of the pump ducts and one of the additional pump ducts are hydraulically connected to each other.

6. A hydraulic control system for a construction vehicle in accordance with claim 5, wherein the terminating element has a controllable summing valve which is connected to the pump ducts and, if necessary, feeds the volumetric currents of the hydraulic fluid flowing through the additional pump ducts to a single hydraulic load.

7. A hydraulic control system for a construction vehicle in accordance with claim 1, wherein the main control block has a controllable hammer valve with a main stage and a pilot stage and a pilot pressure tapping aperture, rendering internal system pilot pressure tapping possible by means of the pilot pressure tapping aperture for the pilot stage, by means of which pilot pressure the main stage is opened and closed.

8. A hydraulic control system for a construction vehicle in accordance with claim 2 wherein the section in the vicinity of the second bypass duct has a one-way restrictor and a blind plug, whereby the one-way restrictor supplies the spool valve with hydraulic fluid by means of the volumetric current provided through pump duct and the blind plug closes a connection between the pump duct and the spool valve hydraulically.

9. A hydraulic control system for a construction vehicle in accordance with claim 4, wherein the options block has a controllable pressure compensator which connects one of the additional pump ducts and the second bypass with each other, the pressure compensator being designed to supply an additional hydraulic load with a desired volumetric current of hydraulic fluid at a desired pressure, independently of the load.

10. A hydraulic control system for a construction vehicle in accordance with claim 1, wherein the sections have a one-way restrictor.

11. A hydraulic control system for a construction vehicle in accordance with claim 1, wherein the sections have a blind plug.

12. A hydraulic control system for a construction vehicle in accordance with claim 1, wherein the sections have a pressure compensator.

* * * * *